United States Patent [19]

Pick

[11] Patent Number: 4,698,610

[45] Date of Patent: Oct. 6, 1987

[54] COIL FRAME ASSEMBLY AND THE METHOD OF MAKING SAME

[75] Inventor: James M. Pick, Elk Grove, Ill.

[73] Assignee: Eaton Corporation, Cleveland, Ohio

[21] Appl. No.: 858,483

[22] Filed: May 1, 1986

[51] Int. Cl.[4] ..... H01F 3/00

[52] U.S. Cl. ..... 335/281; 29/602 R

[58] Field of Search ..... 335/251, 255, 278, 281; 29/602 R

[56] References Cited

U.S. PATENT DOCUMENTS 1,593,384 7/1926 Brown ..... 335/281 X
3,378,732 4/1968 Dietz et al. ..... 335/255 X
3,593,240 7/1971 Garczynski ..... 335/281 X
4,365,223 12/1982 Fechant et al. ..... 335/281

*Primary Examiner*—George Harris
*Attorney, Agent, or Firm*—D. A. Rowe; R. A. Johnston

[57] ABSTRACT

A U-shaped ferro-magnetic pole frame has a circular recess formed in the closed end thereof with a plurality of peripherally spaced raised lugs formed in the recess. A tubular ferro-magnetic pole piece, adapted for insertion into an electrical coil, has one end thereof clamped temporarily against the lugs and current is passed therethrough for effecting resistance welding of the pole piece to the pole frame and the clamp is then removed.

5 Claims, 3 Drawing Figures

COIL FRAME ASSEMBLY AND THE METHOD OF MAKING SAME

BACKGROUND OF THE INVENTION

The present invention relates to Electromagnetic actuators and in particular electromagnetic solenoids such as those employed for water inlet valves used in household appliances. Electromagnetic actuators of this type typically employ a pole frame formed of ferro-magnetic material which surrounds or extends over the outer periphery of an electrical coil with a tubular ferro-magnetic pole piece member connected thereto which extends into the inner region of the coil. The tubular pole piece member has a moveable armature received therein and, in applications such as water valves, employs a non-magnetic member slidably guiding movement of the armature within the pole piece.

Heretofore, the tubular pole piece has been attached to the pole frame by press fitting the end of the pole piece into a circular aperture provided in the pole frame having closely controlled tolerances for the diameter of the aperture to ensure the press fit. The end of the pole piece member, once press fitted into the pole frame aperture, has been retained therein either by suitable metal deformation such as staking, flaring or by a welding operation.

In such known techniques for attaching a tubular pole piece member to a ferro-magnetic pole frame, it has been found prohibitively costly in manufacturing to provide the tight tolerances on the diameter of the pole frame aperture and to maintain tight dimensional control of the diameter of the tubular pole piece member in order to ensure a press fit of the tubular pole piece member in an aperture in the the pole frame. In addition, the necessity of providing a press fit of the tubular pole piece into the pole frame for temporary retention therein until completion of subsequent staking or welding, has required a separate locating fixture and operational step in the assembly. Thus, it has been desired to find a way or means of attaching a tubular pole piece member to a ferro-magnetic coil frame for a solenoid actuator without requiring tight dimensional tolerances of either part. It has further been desired t provide such an assembly without requiring separate tooling and set-up in the fabrication process to provide location and temporary retention of the pole piece member on to the frame, in preparation for a second or a final operation for securing the pole piece on to the pole frame.

SUMMARY OF THE INVENTION

The present invention provides a unique and novel ferro-magnetic pole frame assembly for an electromagnetic actuator such as a soleniod having an electrical coil disposed about an inner pole piece member for moving an armature by magetomotive force upon energization of the coil. The present invention provides an outer pole frame formed of suitable ferro-magnetic sheet or strip stock with a tubular pole piece member attached thereto. The pole frame has a recessed region formed therein with a plurality of peripherally spaced raised portions, or lugs, formed in the recessed region. The tubular pole piece has one end thereof disposed in contact with the raised lugs and is maintained there against while the end of the pole piece member is resistace welded to the lugs by passage of a current there through. The method of the present invention thus enables locating and welding of the tubular pole piece member on to the pole frame without the necessity of tightly controlled dimensions on either part for holding a press fit to maintain alignment during permanent attachment by subsequent deformation or welding.

DETAILED DESCRIPTION

Figure 3:
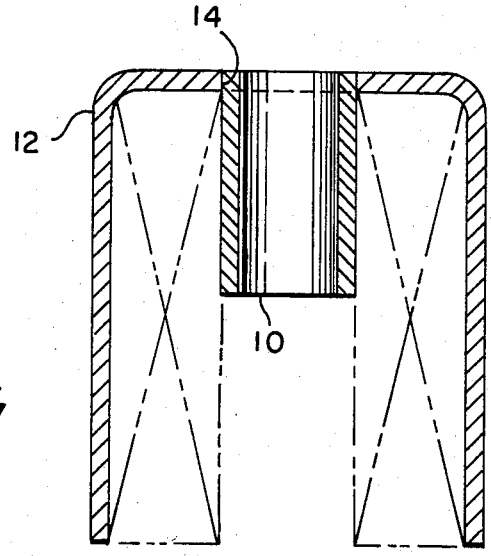
Fig. 3 PRIOR ART
FIG. 3 is a view similar FIG. 2 showing the techniques of the known prior art.

Referring to FIG. 3, the known technique for attaching a tubular ferro-magnetic pole piece number 10 to a ferro-magnetic pole frame 12 is shown wherein an aperture 14 is formed in the pole frame to tightly controlled dimensions. The end of the tubular pole piece member 10 is press fitted into the aperture for temporary retention therein prior to staking or welding.

Figure 1:
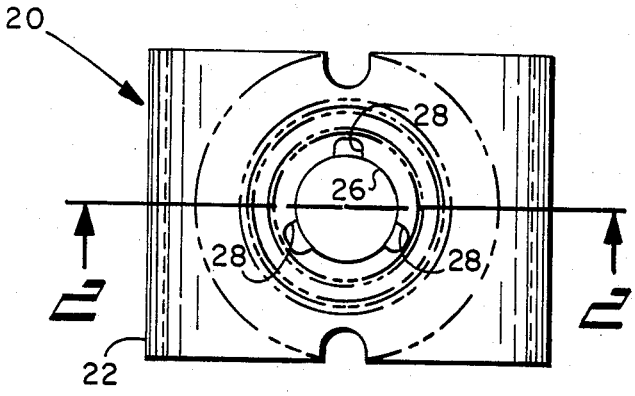
FIG. 1 is a top view of the assembly of the present invention.
Figure 2:
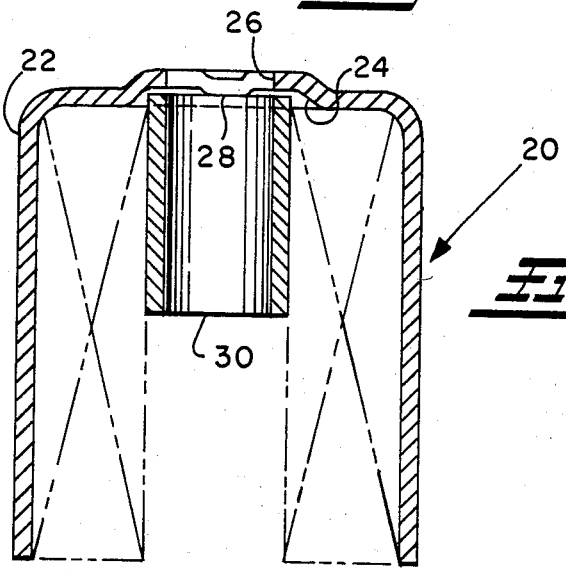
FIG. 2 is section view taken along section indcating lines 2—2 of FIG. 1.

Referring to FIGS. 1 and 2, a ferro-magnetic pole frame assembly in accordance with the teachings of the present invention is indicated generally at 20 and has a generally U-shaped outer pole frame member 22 formed of suitable ferro-magnetic sheet or strip stock adapted for having received therein an electrical coil indicated by phantom outline in FIGS. 1 and 2. The pole frame member 22 has a generally circular recess 24 formed in the closed end thereof by suitable expedient measures such as stamping or embossing.

The recess 24 has a central aperture 26 therethrough and has formed thereon plurality of raised portions or lugs 28 which are disposed in circumferentialy spaced arrangement about the aperture 26 and extending downwardly as illustrated in FIG. 2. In the presently preferred practice of the invention, three of the lugs are coined or stamped in the pole frame 28 about the periphery of aperture 26 in an equally spaced arrangement; and, lugs 28 are raised from the inner surface of the depression 24 by an amount equal to approximately one-half to one full thickness of the stock from which the pole frame is fabricated. Preferably, the diameter of the circular recess 24 is chosen generally the same as the outer diameter of the tubular pole piece 30 such that when the pole piece 30 is received in the recess, the recess 24 serves to locate the pole piece 30 on the pole frame 22.

With reference to FIG. 2, the tubular pole piece 30 formed of ferro-magnetic material having a generally thin wall with respect to its outer diameter, has the upper end thereof disposed in contact with the under surface of the lugs 28, which contact is shown with respect to one of the lugs 28 in FIG. 2. The pole piece 30 is then abutted with a suitable clamp or anvil (not shown) and pressed against the lugs 28 to temporarily maintain metal-to-metal contact therebetween. With the pole piece 28 clamped at its upper end firmly in contact the lugs 28, a suitable welding current is passed through the pole frame and pole piece to effect resistance welding of the end of the pole piece tube 30 on to the lugs 28. When the resistance welding is completed, the clamping mechanism maybe removed.

The present invention thus provides a unique and novel way of forming a pole frame assembly for an electromagnetic actuated device having an electrical coil. The cool pole frame has a tubular pole piece member adapted for being received within the coil is located on the pole frame by a recess formed therein, which recess has a plurality of raised portions or lugs which make contact with the end of the pole piece received in the recess to enable locating the pole piece and resistance welding of the tubular pole piece onto the raised portions. The present invention thus eliminates the need for interference or press fitting of a tubular pole piece frame for completing an electromagnetic pole frame assembly for a solenoid actuated device.

Although the invention has hereinabove been described with respect to the presently preferred practice, it will be understood that modifications and variations may be made to the present invention which is limited only by the following claims.

I claim:

1. A pole frame assembly for an electromagnetic device comprising:

(a) a frame member formed of ferro-magnetic material and having a generally U-shaped configuration and having a recess formed in the closed end of said U-shaped, said recess having a plurality of raised surface portions disposed thereabout in peripherally spaced arrangement;

(b) a pole piece member formed of ferro-magnetic material and having a generally tubular configuation, with one therof disposed in said recess and registered therein in contact with said raised surface portions and resistance welded thereto for securing said pole piece member to said frame, said pole piece being adapted for insertion into the inner periphery of an electrical coil.

2. The assembly defined in claim one, wherein said recess has a generally circular dished configuraiton with at least three of said raised portions formed in said recess.

3. The assembly defined in claim one, where said recess has a generally flat-bottomed circular configuation with at least three of said raised portions formed in said flat bottom.

4. The assembly defined in claim one, wherein said pole frame member is formed of a unitary piece of strip stock generally thin with respect to the width thereof.

5. A method of making a pole frame assembly for an electromagnetic device comprising the steps of:

(a) forming a generally U-shped member from a strip of ferro-magnetic material thin with respect to the width thereof and forming a recess in the closed end of said U-shape;

(b) forming a plurality of localized peripherally spaced raised portions in said recess; and (c) locating and maintaining one end of a tubular ferro-magnetic pole piece against said raised portions and resistance welding the end of said tubular pole piece thereto.

* * * * *